US008456259B2

(12) United States Patent
Safreed, III et al.

(10) Patent No.: US 8,456,259 B2
(45) Date of Patent: Jun. 4, 2013

(54) PORTABLE ACTUATOR

(75) Inventors: Russell R. Safreed, III, St. Albans, WV (US); Charles Mark McClung, Elkview, WV (US)

(73) Assignee: MarTek Limited, Charleston, WV (US)

( * ) Notice: Subject to any disclaimer, the term of this patent is extended or adjusted under 35 U.S.C. 154(b) by 57 days.

(21) Appl. No.: 13/182,692

(22) Filed: Jul. 14, 2011

(65) Prior Publication Data

US 2012/0024677 A1 Feb. 2, 2012

Related U.S. Application Data

(60) Provisional application No. 61/369,918, filed on Aug. 2, 2010.

(51) Int. Cl.
*H01H 75/00* (2006.01)

(52) U.S. Cl.
USPC ..... 335/6; 335/68; 335/172; 335/173; 200/330; 200/331

(58) Field of Classification Search
USPC ..... 335/6, 68, 172, 174, 175; 200/330, 200/331
See application file for complete search history.

(56) References Cited

U.S. PATENT DOCUMENTS 5,504,290 A * 4/1996 Baginski et al. ..... 200/401
7,623,011 B2 11/2009 Rowe et al.

* cited by examiner

*Primary Examiner* — Ramon Barrera
(74) *Attorney, Agent, or Firm* — Thomas|Horstemeyer, LLP

(57) ABSTRACT

Disclosed are various embodiments for a portable actuator for actuating a trip button and a close button of a circuit breaker. In one embodiment, the trip button is actuated by a linear actuator that transmits rotation forces produced by a motor to the trip button in response to a trip signal. The close button is actuated by a rotating arm that uses an anti-friction roller to apply a rotating motion to the close button in response to a close signal. The portable actuator is configured to receive the input signals from a remote location with a remote controller that is in electronic communication with the portable actuator.

23 Claims, 8 Drawing Sheets

PORTABLE ACTUATOR

CROSS REFERENCE TO RELATED APPLICATIONS

This application claims priority to U.S. provisional application entitled "PORTABLE ACTUATOR AND METHOD" having Ser. No. 61/369,918, filed Aug. 2, 2010, the entirety of which is hereby incorporated by reference.

BACKGROUND

A circuit breaker is designed to protect an electrical circuit from damage caused by a short circuit. For example, the circuit breaker may interrupt the continuity of the electrical circuit, thereby discontinuing the electrical flow. In large scale electrical systems, a typical circuit breaker is operated by a human operator who physically pushes a "trip" or "close" button located on the face of the circuit breaker. For instance, the human operator may stand within a close proximity to the circuit breaker and manually actuate the button. Upon actuating the button, the circuit breaker functions to interrupt the electrical flow within the circuit.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Disclosed are various embodiments for a portable actuator capable of being remotely operated to actuate a circuit breaker. In the following discussion, a general description of the system and its components is provided, followed by a discussion of the operation of the same.

Figure 1:
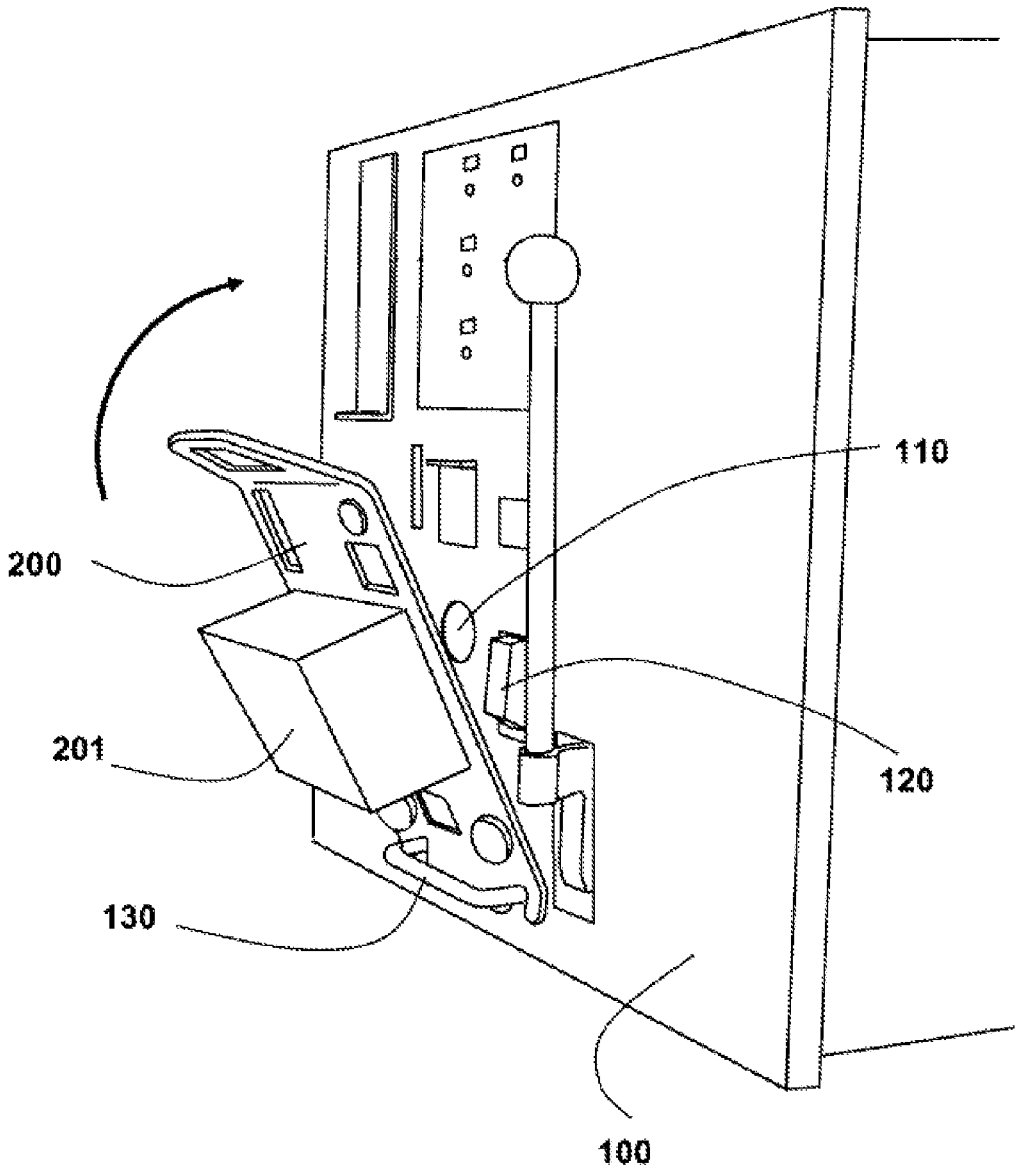
FIG. 1 is a drawing of a typical circuit breaker according to various embodiments of the present disclosure.

With reference to FIG. 1, shown is a portable actuator 200 according to various embodiments. The portable actuator 200 may be affixed to a circuit breaker 100 and configured to actuate the circuit breaker 100. In one embodiment, the portable actuator 200 includes a protective covering 201 that protects a gearbox configured to actuate the circuit breaker 100, as will be described. In addition, a set of geometric dimensions of the portable actuator 200 may correspond to the geometric dimensions of the circuit breaker 100. For instance, the length and width of the portable actuator 200 may correspond substantially to the length and width of a front dimension of the circuit breaker 100.

In one embodiment, the portable actuator 200 may engage the breaker pull handle 130 to initiate affixing to the circuit breaker 100. For instance, engaging the breaker pull handle 130 may ensure that the portable actuator 200 is properly aligned with the circuit breaker 100 to effectively actuate the circuit breaker 100. The portable actuator 200 may be affixed to the circuit breaker 100 by aligning a bottom portion of the portable actuator 200 with the breaker pull handle 130 at an acute angle, as shown in FIG. 1. Then, as shown in FIG. 1, by rotating a top portion of the portable actuator 200 in a clockwise direction until the top portion engages the front dimension of the circuit breaker 100, the portable actuator 200 may be affixed to the circuit breaker 100. In one embodiment, proper alignment with the circuit breaker 100 may ensure that the gearbox being protected by the protective covering 201 is properly positioned over the circuit breaker controls 110/120.

Figure 2:
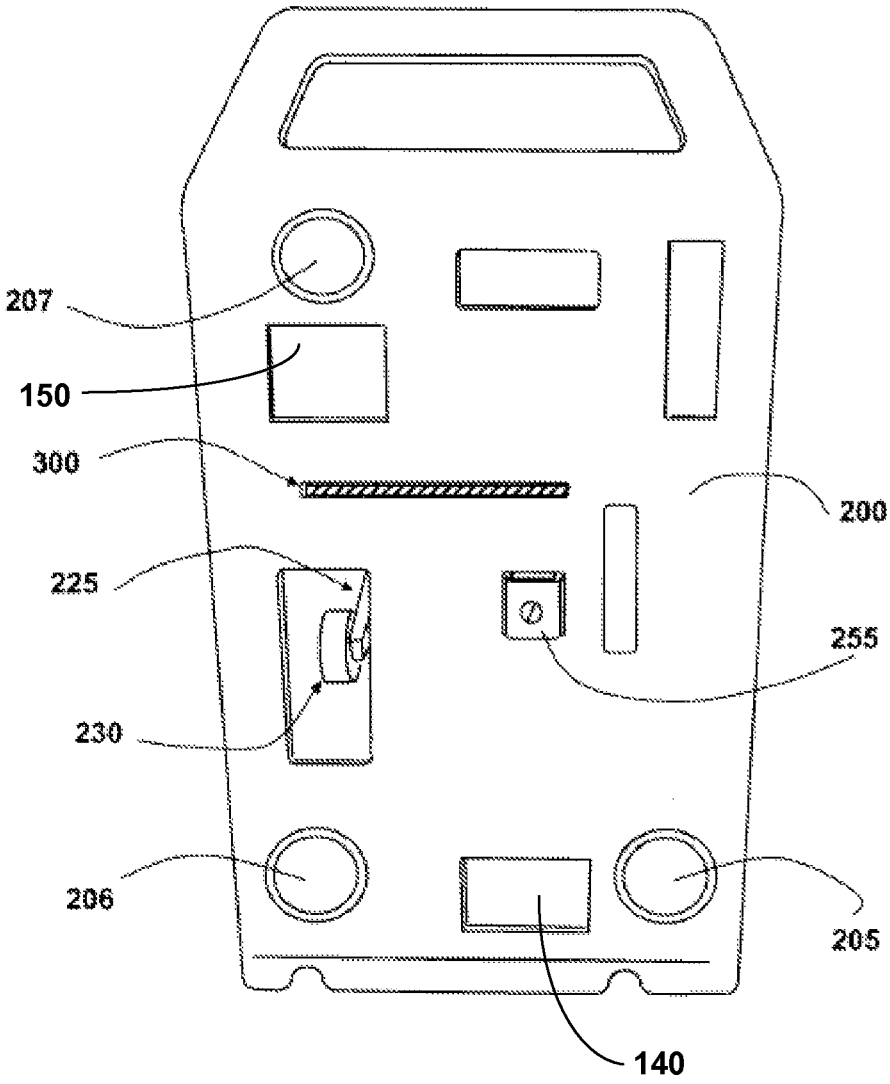
FIG. 2 is a perspective view of the under-side of an actuator frame.

Moving now to FIG. 2, shown is an under-side view of the portable actuator 200 according to various embodiments. In one embodiment, magnets 205, 206, and 207 may be used to secure the portable actuator 200 onto the circuit breaker 100 once the portable actuator 200 is aligned properly against the circuit breaker 100. In another embodiment, any other form of securing mechanism may be used, such as, for instance, adhesives, Velcro, screws, nuts and bolts, and/or any other securing mechanism. Further, the number of magnets 205/206/207 may correspond to the geometric dimensions of the portable actuator 200. For instance, a larger set of geometric dimensions may require a higher number of magnets 205/206/207 to effectively secure the portable actuator 200 onto the circuit breaker 100.

In one embodiment, the portable actuator 200 may also include openings for portions of the motor to interact with controls 110/120 (FIG. 1) of the circuit breaker 100. For instance, a portion of an actuator arm 225 and an anti-friction roller 230 may interact with the circuit breaker 100 through an insert to perform various functions, as will be described. Additionally, a portion of a trip pushrod 255 and a portion of a safety interlock 300 may be visible on the under-side of the portable actuator 200 to perform various functions, as will be described. Further, in one embodiment, the portable actuator 200 may also include status openings 140/150 to ensure the ability to view status indicators appearing on the circuit breaker 200 when the portable actuator 200 is secured against the circuit breaker 200.

Figure 3A:
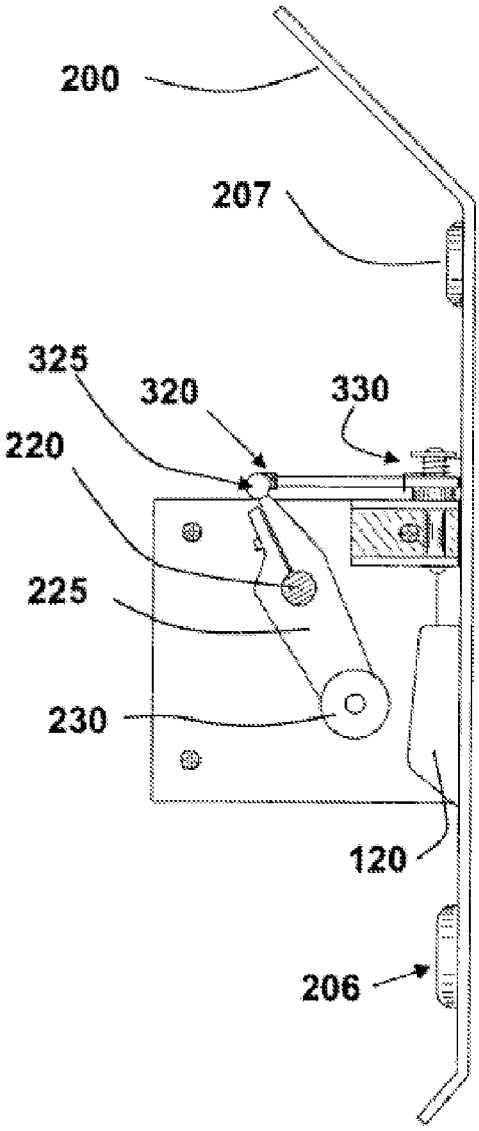
FIG. 3A is a view of the right side of the actuator where the actuator is in a neutral position.

Next, in FIG. 3A, shown is a right-side view of the portable actuator 200 according to various embodiments. As shown in FIG. 3A, the portable actuator 200 is in a neutral position as exhibited by the actuator arm 225 being positioned such that there is no contact with the control button 120. For instance, in this example, the control button 120 is a "close" button 120. In addition, the actuator arm 225 being in a neutral position allows for a magnetic interaction between the safety interlock retention magnet 325 and the safety interlock ferrous target 320. In one embodiment, the magnetic interaction between the safety interlock retention magnet 325 and the safety interlock ferrous target 320 overcomes a rotational force exhibited by a safety interlock actuating spring 330 to function as a safety locking mechanism and prevent the installation of the portable actuator 200 onto to the circuit breaker 100, as will be described with respect to FIG. 9.

In one embodiment, the actuator arm 225 is controlled by a gear motor output shaft 220 which can be rotated in either a clockwise or counter-clockwise direction based on a received signal. As viewed from the right side of the actuator, the gear motor output shaft 220 may rotate in a clock-wise direction if a "neutral" command is received. By rotating in a clock-wise direction, the gear motor output shaft 220 rotates the actuator arm 225 away from the "close" button 120 thereby placing the portable actuator 200 in a "neutral" position. For example, the actuator arm 225 cannot actuate the "close" button 120 without being in contact with the "close" button 120. In one embodiment, the gear motor output shaft 220 may always keep the actuator arm 225 in a "neutral" position unless a "close" command or a "trip" command is received.

Figure 3B:
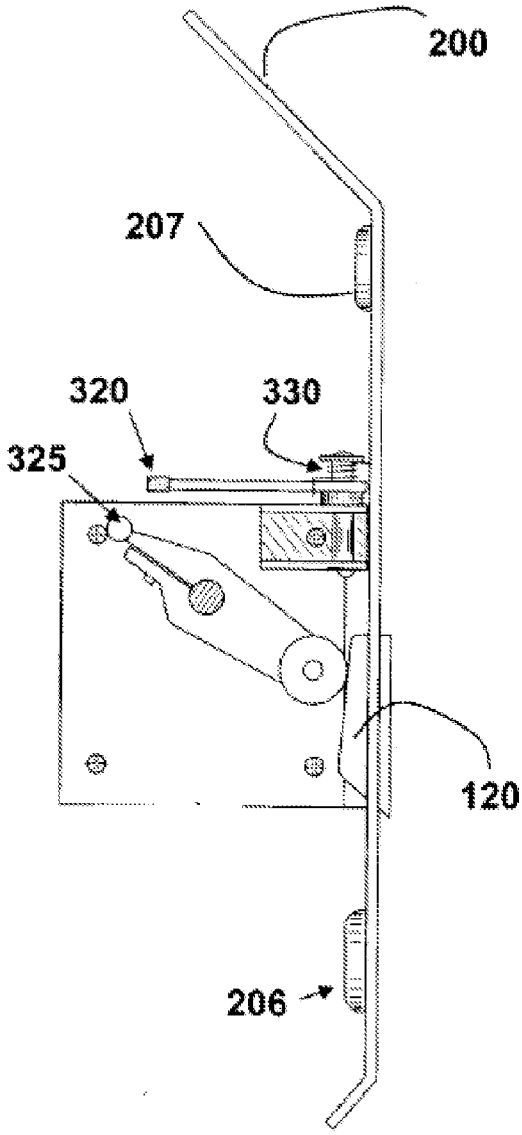
FIG. 3B is a view of the right side of the actuator where the actuator is in a "close" position.

In FIG. 3B, shown is a right-side view of the portable actuator 200 according to various embodiments. As shown in FIG. 3B, the portable actuator 200 is in a "close" position as exhibited by the actuator arm 225 being in contact with the close button 120. In addition, the safety interlock 300 is not secured by any magnetic attraction between the safety interlock retention magnet 325 and the safety interlock ferrous target 320.

In one embodiment, upon receiving a signal to "close" the circuit breaker 100, the gear motor output shaft 220 rotates in a counter-clockwise direction causing the actuator arm 225 to press against the close button 120 with a predetermined amount of rotational force to actuate the close button 120. For instance, an anti-friction roller 230 attached at one end of the actuator arm 225 actuates the close button 120 when the actuator arm 225 is rotated towards the portable actuator 200. In one embodiment, the gear motor output shaft 220 provides a predetermined amount of rotational force to actuate the close button 120. For example, the gear motor output shaft 220 may provide a sufficient amount of force to depress the close button 120 for a predetermined amount of time. In addition, the gear motor output shaft 220 may retain the actuator arm 225 in position such that the anti-friction roller 230 is actuating the close button 120 until a "close" signal is no longer received.

Figures 4A, 4B, 4C:
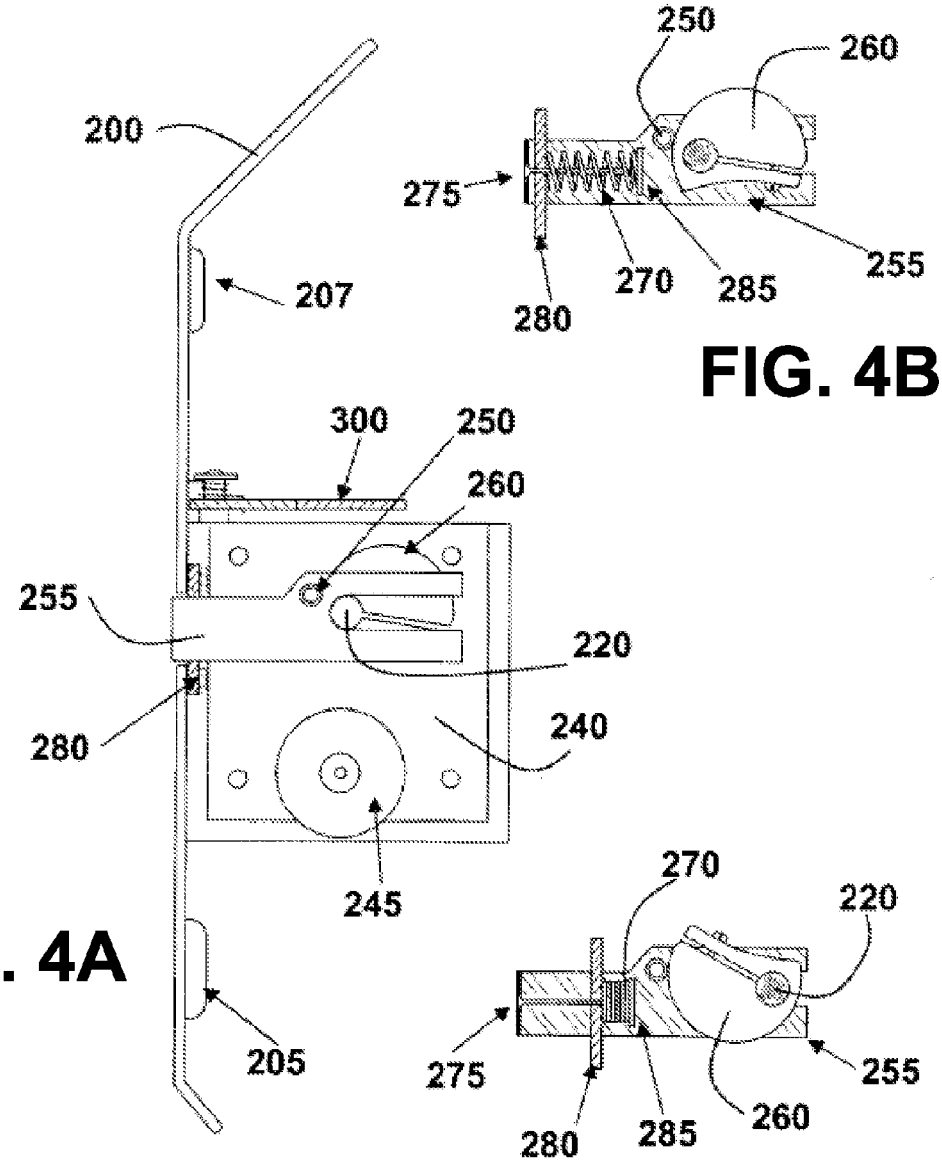
FIG. 4A is a view of the left side of the actuator where the actuator is in a neutral position.
FIG. 4B is a view of the "trip" pushrod and cam, in the neutral position.
FIG. 4C is a view of the "trip" pushrod and cam, in the "trip" position.

Next, in FIG. 4A, shown is a left-side view of the portable actuator 200 according to various embodiments. As shown in FIG. 4A, the portable actuator 200 is in a "neutral" position as exhibited by a tip of the trip pushrod 255 being in position along a same plane as the portable actuator 200. In one embodiment, the gear motor output shaft 220 pushes the trip pushrod 255 through an insert in the plane of the portable actuator 200 thereby breaking the plane of the portable actuator 200. The gear motor output shaft 220 may push the trip pushrod 255 a predetermined amount in order to actuate the "trip" button 110 (FIG. 1) upon receiving a "trip" signal, as will be described.

In one embodiment, as viewed from the left side of the actuator, the gear motor output shaft 220 rotates in a counter clock-wise direction causing the trip pushrod 255 to actuate the trip button 110 upon receiving a "trip" signal to trip the circuit breaker 100. For instance, a gear motor 245 energizes the gear motor output shaft 220 which initiates the process to push the trip pushrod 255 using an actuating cam 260, a cam follower 250, and a pushrod support 280, as will be described with respect to FIGS. 4B and 4C.

Moving now to FIG. 4B, the trip pushrod 255 is depicted in a neutral position shown from the left side, according to various embodiments. In one embodiment, an actuating cam 260 is adjoined to the gear motor output shaft 220. As such, the actuating cam 260 rotates in either a clockwise direction or a counter-clockwise direction along with the gear motor output shaft 220. Thus, if the gear motor 245 causes the gear motor output shaft 220 to rotate in a clockwise direction, the actuating cam 260 also rotates in a clockwise direction at the same speed. Further, also shown in FIG. 4B, is a pushrod return screw 275 comprising a pushrod return spring 270 and a pushrod screw flange nut 285. The pushrod return screw 275 functions with the pushrod support 280 to actuate the trip button 110 (FIG. 1) using the trip pushrod 255, as will be described in FIG. 4C.

Next, in FIG. 4C, the trip pushrod 255 is depicted in a trip position shown from the left side. In this example, the trip pushrod 255 is pushed in a linear manner thereby causing the trip pushrod 255 to break the plane of the portable actuator 200 and actuate the trip button 110 (FIG. 1), as described above. In one embodiment, the gear motor 245 receives a "trip" command causing the gear motor output shaft 220 to rotate in a counter-clockwise direction. As such, the actuating cam 260 also rotates in a counter-clockwise direction while acting upon the cam follower 250. In one embodiment, the rotating actuating cam 260 causes the trip pushrod 155 to pull on the pushrod return screw 275 thereby compressing the pushrod return spring 270 between the pushrod screw flange nut 285 and the pushrod support 280. While pulling on the pushrod return screw 275, the trip pushrod 255 moves in a linear direction towards the circuit breaker 100 with the aid of the trip actuating cam 260. As such, the trip pushrod 255 moves in a linear direction to depress the trip button 110 on the circuit breaker 100 while being spring loaded via the pushrod return spring 270.

Then, in one embodiment, when the gear motor 245 stops receiving a "trip" signal and/or receives a "neutral" signal, the gear motor 245 reverses direction causing the gear motor output shaft 220 to rotate in a clockwise direction. As such, the trip actuating cam 260 also rotates in a clockwise direction causing the compressed pushrod return spring 270 to begin decompressing by pushing against both the pushrod support 280 and the pushrod screw flange nut 285. Thus, the trip pushrod 255 returns to the neutral position as shown in FIG. 4A by moving in a linear direction away from the circuit breaker 100.

Figure 5A:
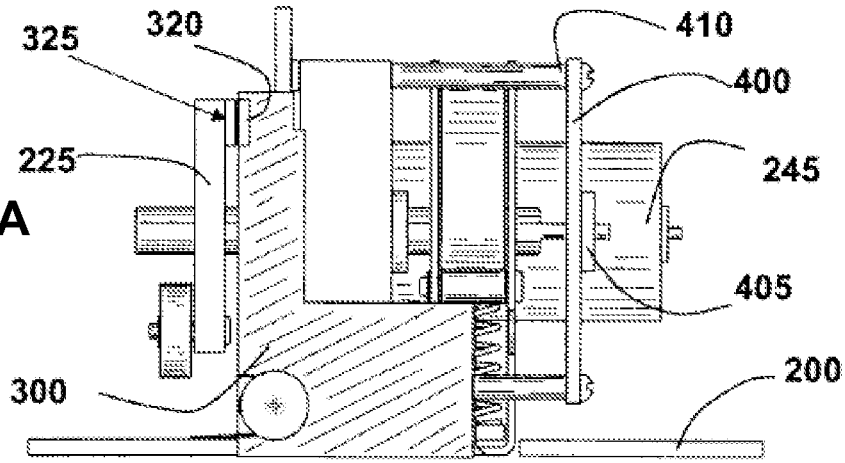
FIG. 5A is a top view of the actuator with the safety interlock in the normal position.

As shown in FIG. 5A, shown is a top view of the portable actuator 200 in a neutral position. In the neutral position, the safety interlock 300 allows for the portable actuator 200 to be affixed to the circuit breaker 100. In one embodiment, the safety interlock retention magnet 325 displaced on one end of the actuator arm 225 is magnetically connected to the safety interlock ferrous target 320 displaced on one end of the safety interlock 300. In this example, the magnetic attraction between the safety interlock retention magnet 325 and the safety interlock ferrous target 320 is sufficient to overcome any rotational forces produced by the safety interlock actuating spring 330 (FIG. 3A). As such, the safety interlock 300 remains in position despite the rotational forces of the safety interlock actuating spring 300. Thus, the magnetic attraction between the safety interlock retention magnet 325 and the safety interlock ferrous target 320 functions to hold the safety interlock 300 in position while the portable actuator 200 is in a neutral position.

Figure 5B:
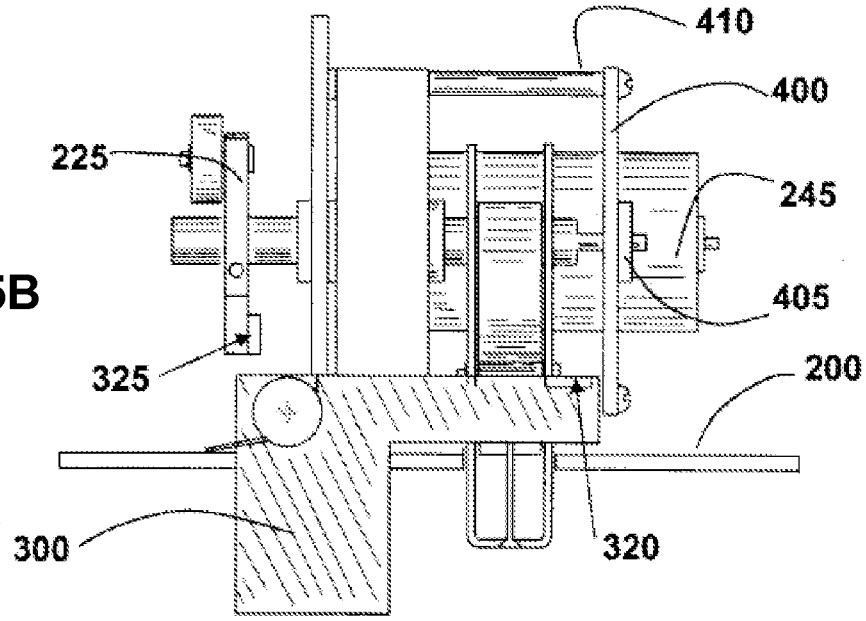
FIG. 5B is a top view of the actuator with the safety interlock in the "prohibit" position.

Next, in FIG. 5B, shown is a top view of the portable actuator 200 in a trip position. In the trip position, the safety interlock prevents the portable actuator 200 from being affixed to the circuit breaker 100. In this embodiment, the safety interlock retention magnet 325 is no longer magnetically connected to the safety interlock ferrous target 320. Here, the magnetic attraction between the safety interlock retention magnet 325 and the safety interlock ferrous target 320 is no longer sufficient to overcome the rotational forces exhibited by the safety interlock actuating spring 330 (FIG. 3A). As such, the safety interlock 300 rotates approximately ninety degrees in a clockwise direction and protrudes from the portable actuator 200, thereby prohibiting installation of the portable actuator 200. Thus, the safety interlock 300 may prevent any inadvertent operation of the circuit breaker 100 by preventing the portable actuator from being affixed to the circuit breaker 100 when the portable actuator 200 is not in a neutral position.

Figure 6:
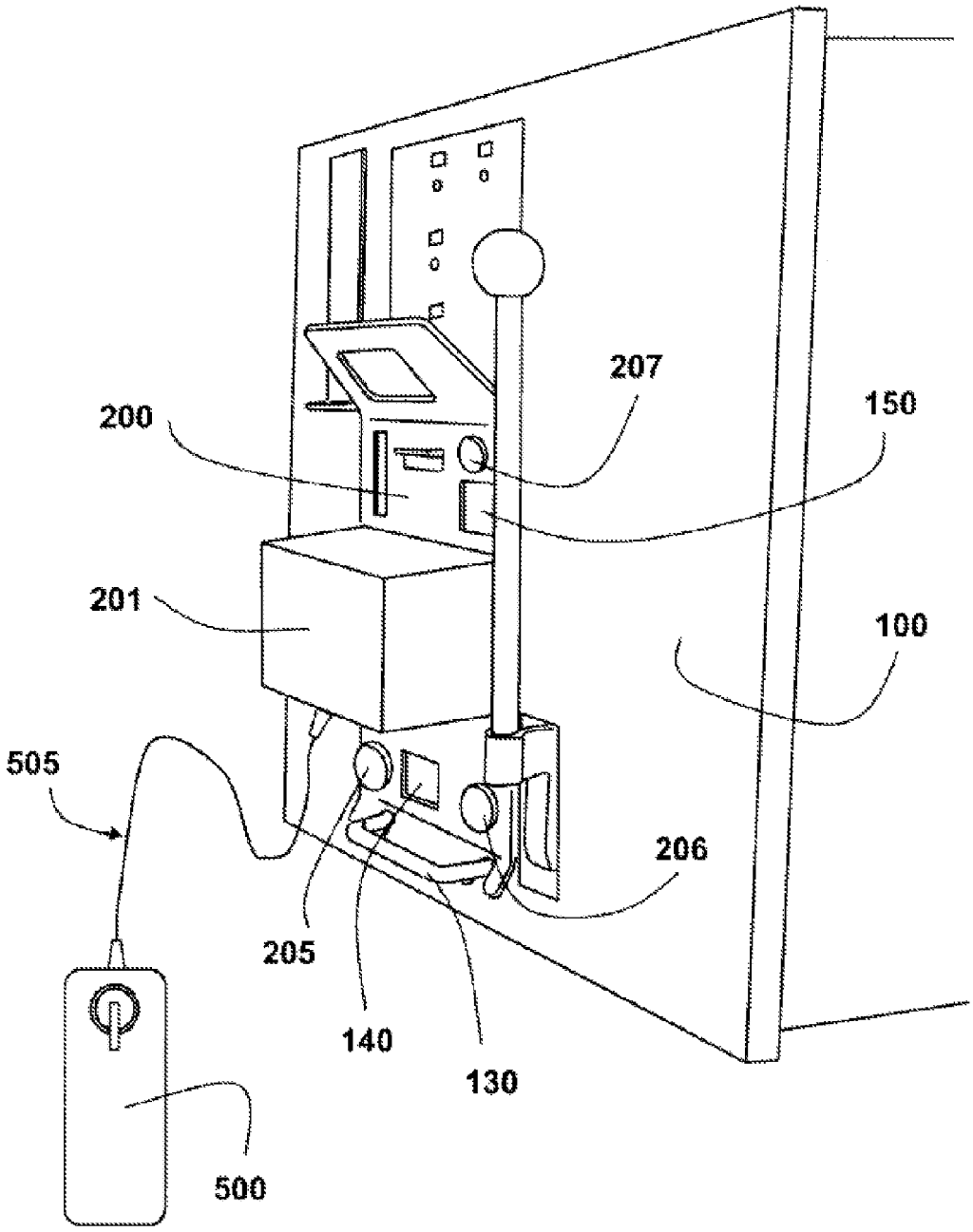
FIG. 6 is a perspective view of the actuator installed on a typical circuit breaker, along with the remote control for the actuator.
Figure 7:
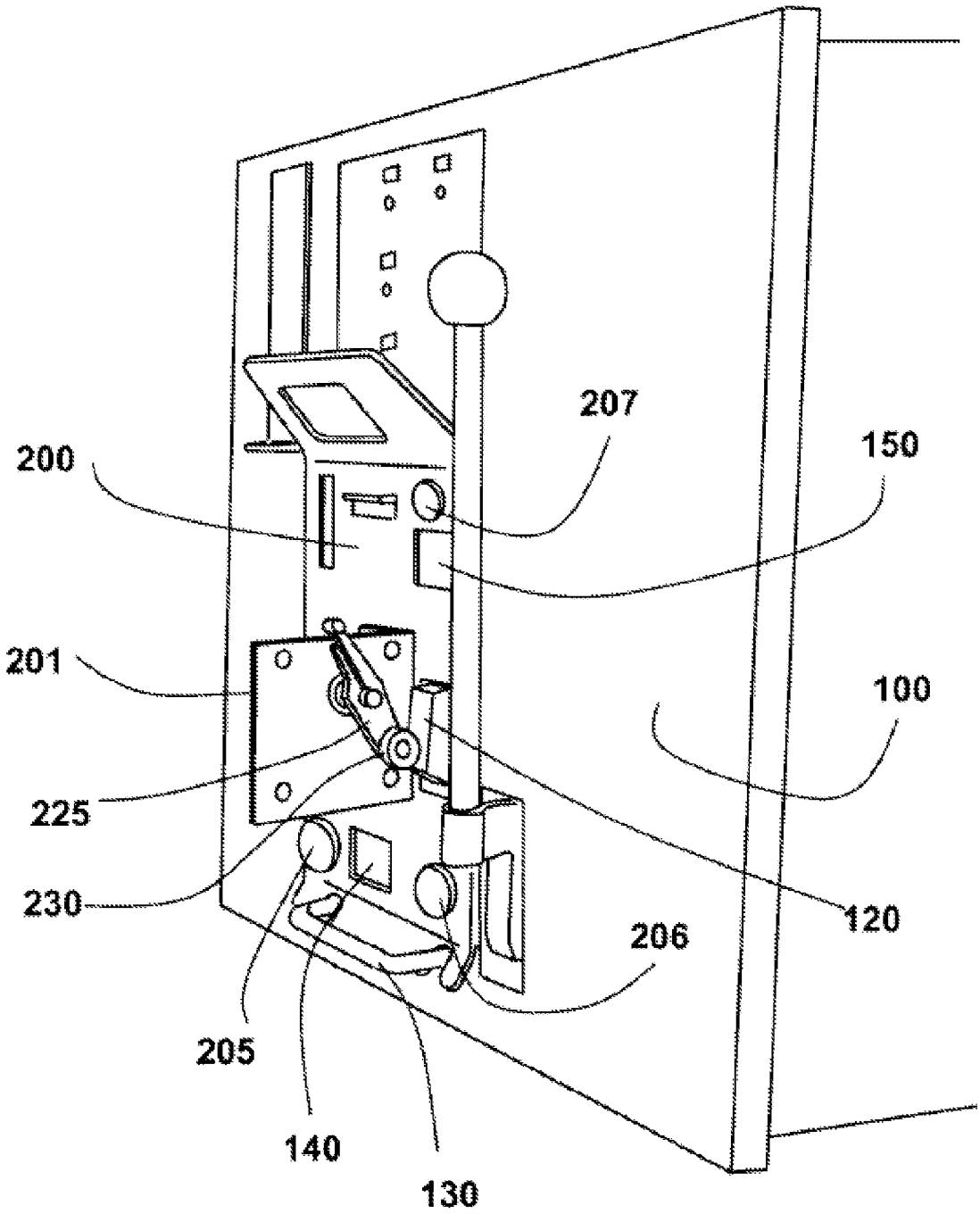
FIG. 7 is a perspective view of the portable actuator in place, as viewed from the right side of the actuator cover and with the safety interlock removed.

Moving now to FIGS. 6 and 7, shown is one embodiment of a portable actuator 200 affixed to a circuit breaker 100, according to the embodiments described above. In FIG. 6, a protective covering 201 protects the components energized by the gear motor 245 (FIG. 4A), as described above. Additionally, a remote control 500 is shown as providing input signals to the portable actuator 200. For instance, the signals may be indicative of a command to trip the circuit breaker 100, close the circuit breaker 100, place the portable actuator 200 in a neutral position, and/or any other type of input signal. In FIG. 7, the protective covering 201 of FIG. 6 is removed to reveal the protected components of the portable actuator 200. In this example, the portable actuator 200 is viewed from the right side.

Figure 8A:
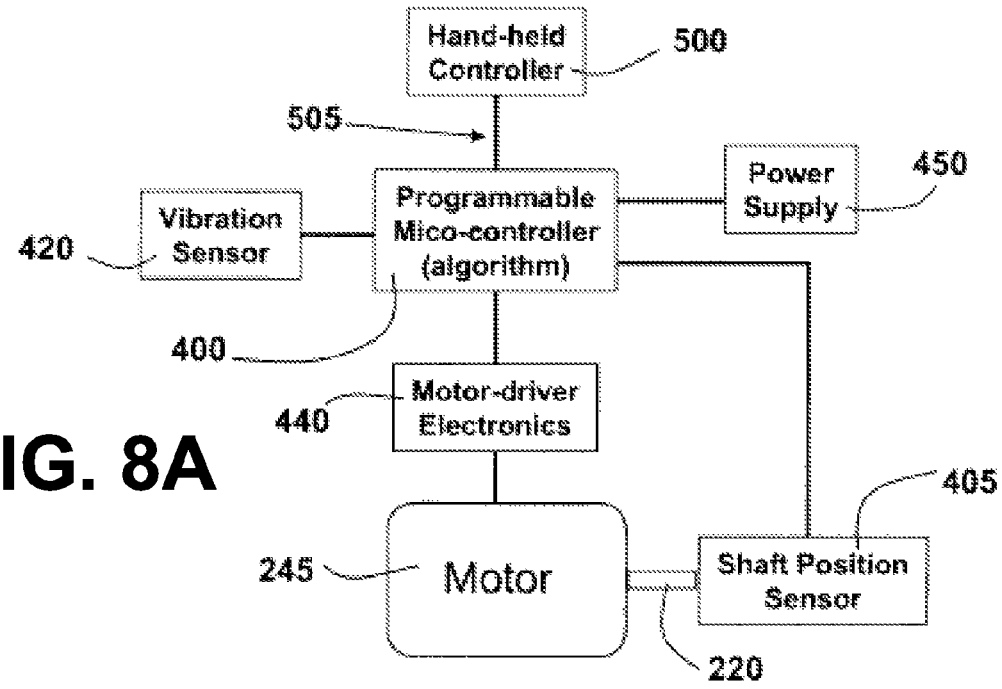
FIGS. 8A, 8B, and 8C are block diagrams of one embodiment of a control system for the portable actuator.
Figure 8B:
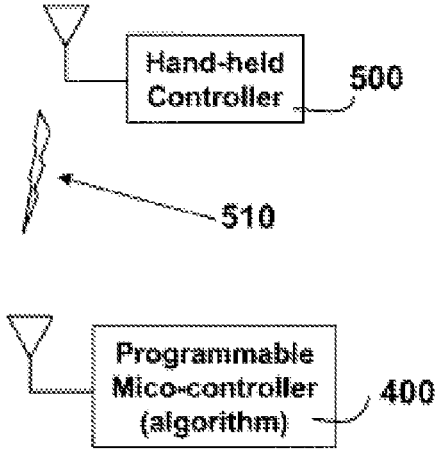
Figure 8C:
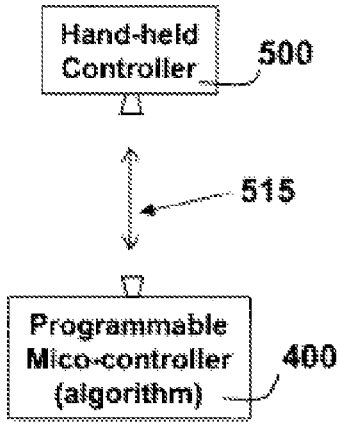

Next, shown in FIG. 8A is a block diagram of one embodiment for a bidirectional system of communication between the remote control 500 and a circuit board control system 400. In one embodiment, the bidirectional communication between the remote control 500 and the circuit board control system may be accomplished using a communication cable 505, radio communication as shown in FIG. 8B and infrared communication as shown in FIG. 8C, and/or any other form of communication medium. As an example, the circuit board control system 400 receives input signals from the remote control 500, such as, for example, trip, close, and/or neutral, and transmits a command to the motor driver electronics component 440 based on the received signal. For instance, the circuit board control system 400 may transmit a command to the motor driver electronics component 440 to energize the gear motor 245 if a trip signal is received from the remote control 500.

In one embodiment, a power supply 450 provides energy to power the circuit board control system 400 and the motor driver electronics component 440. In addition, an optional vibration sensor 420 may be employed to sense an operation of the circuit breaker 100 (FIG. 1). For instance, the vibration sensor 420 may sense a vibration caused by the circuit breaker 100 opening and/or closing and may then transmit a command to the circuit board control system 400 to turn off the motor driver electronics component 440 and/or indicate to a user that the circuit breaker 100 has operated. In another embodiment, a shaft position sensor 405 may transmit a signal to the circuit board control system 400 based on angular position of the gear motor 245. For instance, the circuit board control system 400 may transmit a command to the motor to rotate in a clockwise direction and/or a counter clockwise direction based on the signal received from the remote control 500.

In another embodiment, the circuit board control system 400 may monitor the gear motor 245 to sense whether the portable actuator 200 is operating. For instance, the circuit board control system 400 may monitor a current level of the gear motor 245 to determine when the trip pushrod 255 is in operation and/or when the trip pushrod 255 ceases operation. Similarly, the circuit board control system 400 may also monitor the current level to determine when the actuator arm 225 is in and out of operation. In another embodiment, the circuit board control system 400 may measure any other component of the gear motor 245 to monitor the operating state of the portable actuator 200.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A portable actuator for remote operation of a circuit breaker, the portable actuator comprising:

an actuator frame for supporting and positioning the portable actuator in relationship to a plurality of circuit breaker operating controls without obscuring a breaker status window and a spring status window;

a plurality of magnets for holding the actuator frame in a proper position relative to a pull handle and a faceplate associated with the circuit breaker, wherein the holding occurs by magnetic attraction;

at least one electric motor and an associated gearbox mounted to the actuator frame;

a linear actuator that transmits a rotational force produced by the at least one electric motor and the associated gearbox to a trip button, wherein the trip button is one of the plurality of circuit breaker operating controls;

a rotating arm having an anti-friction roller on one end of the rotating arm for applying a rotating motion to a close button, wherein the close button is a second one of the plurality of circuit breaker operating controls;

a safety interlock device that prohibits installation of the portable actuator to the circuit breaker when the portable actuator is not in a neutral position;

an angular sensor that senses an angular position of the associated gearbox;

a controller for operating the at least one electric motor; and a control station for controlling the portable actuator, wherein the control station is configured to be operated remotely by a human operator.

2. The portable actuator of claim 1 further comprising an encoder associated with the associated gearbox for tracking a position of an output shaft of the motor and communicating with the controller.

3. The portable actuator of claim 2, wherein the encoder is at least one of a digital absolute position indicating encoder and a variable resistance potentiometer.

4. The portable actuator of claim 1, wherein the magnets are at least one of a plurality of permanent magnets and a plurality of electromagnets.

5. The portable actuator of claim 1, wherein the actuator frame is configured to engage a pull handle associated with the circuit breaker for aligning the portable actuator with the circuit breaker.

6. The portable actuator of claim 1, wherein a vibration sensor detects operation of the circuit breaker.

7. The portable actuator of claim 1, wherein the controller communicates with the control station by at least one of a multi-conductor cable, a radio communicative device, and an infrared communicative device.

8. The portable actuator of claim 1, wherein the controller operates the electric motor based on determining at least one of a linear force and a rotational force of the electric motor as a function of at least one of a current and a wattage associated with the electric motor.

9. A system, comprising:

a portable actuator, the portable actuator comprising:

an actuator frame configured to engage a front cover of a circuit breaker and align with the circuit breaker; and a plurality of actuating mechanisms powered by an electric motor comprising at least one rotating arm, wherein the actuating mechanisms are configured to actuate a plurality of control buttons of the circuit breaker; and a remote controller configured to provide a plurality of signals to the portable actuator from a remote location.

10. The system of claim 9, wherein the actuator frame is configured to engage a pull handle associated with the circuit breaker.

11. The system of claim 9, wherein the actuating mechanisms comprises a linear actuator configured to transfer a rotation force produced by the electric motor to a trip button associated with the circuit breaker.

12. The system of claim 9, wherein the at least one rotating arm is configured to apply a rotating motion to a close button associated with the circuit breaker.

13. The system of claim 12, wherein the rotating arm includes an anti-friction roller attached to one end of the rotating arm.

14. The system of claim 9, further comprising a safety interlock device configured to prevent the portable actuator from inadvertently actuating the circuit breaker.

15. The system of claim 14, wherein the safety interlock device allows for the portable actuator to be affixed to the circuit breaker when the portable actuator is a neutral state.

16. The system of claim 9, wherein the remote controller transmits signals indicative of at least one of a neutral state, a trip state, and a close state.

17. A system, comprising:

a portable actuator, the portable actuator comprising:

an actuator frame configured to engage a circuit breaker and align with the circuit breaker; and a plurality of actuating mechanisms powered by an electric motor comprising at least one rotating arm, wherein the actuating mechanisms are configured to actuate a plurality of control buttons of the circuit breaker;

a remote controller configured to provide a plurality of signals to the portable actuator from a remote location; and wherein the actuator frame comprises a plurality of magnets for magnetically affixing the portable actuator with a faceplate associated with circuit breaker.

18. A system, comprising:

a portable actuator, the portable actuator comprising:

an actuator frame configured to engage a circuit breaker and align with the circuit breaker; and a plurality of actuating mechanisms powered by an electric motor comprising at least one rotating arm, wherein the actuating mechanisms are configured to actuate a plurality of control buttons of the circuit breaker;

a remote controller configured to provide a plurality of signals to the portable actuator from a remote location; and wherein the electric motor is controlled based on determining at least one of a linear force and a rotational force of the electric motor as a function of at least one of a current and a wattage associated with the electric motor.

19. A system for remotely controlling a portable actuator, comprising:

means for receiving an input signal from a remote location;

means for electronically actuating a trip button of a circuit breaker based on the received input signal comprising at least one rotating arm; and means for electronically actuating a close button of a circuit breaker based on the received input signal.

20. The system of claim 19, further comprising means for preventing inadvertent operation of the circuit breaker.

21. The system of claim 19, wherein the means for electronically actuating the trip button comprises a linear actuator configured to transfer a rotation force produced by an electric motor to the trip button.

22. The system of claim 19, wherein the rotating arm is configured to apply a rotating motion to the close button.

23. The system of claim 19, wherein the portable actuator further comprises an actuator frame configured to engage a pull handle associated with the circuit breaker to properly align with a plurality of control buttons of the circuit breaker.

* * * * *